US006176251B1

(12) United States Patent
Borgogno

(10) Patent No.: US 6,176,251 B1
(45) Date of Patent: Jan. 23, 2001

(54) VALVE ASSEMBLY IN PARTICULAR FOR A PRESSURE WASHER

(75) Inventor: Angelo Borgogno, La Morra (IT)

(73) Assignee: Mim Hydro S.R.L., Bra (IT)

( * ) Notice: Under 35 U.S.C. 154(b), the term of this patent shall be extended for 0 days.

(21) Appl. No.: 09/234,136

(22) Filed: Jan. 19, 1999

(30) Foreign Application Priority Data

Jan. 20, 1998 (IT) ..... TO98A0050

(51) Int. Cl.[7] ..... F16K 11/10
(52) U.S. Cl. ..... 137/115.07; 137/115.23
(58) Field of Search ..... 137/115.07, 108, 137/11, 123, 119.05, 106

(56) References Cited

U.S. PATENT DOCUMENTS 2,573,231 * 10/1951 Teague, Jr. ..... 137/115.07 X
3,559,670 * 2/1971 Yedidiah ..... 137/110
5,067,654 * 11/1991 Paige ..... 137/625.38 X
5,092,362 * 3/1992 Yie ..... 137/881 X
5,117,872 * 6/1992 Yie ..... 137/882
5,236,002 * 8/1993 Martin et al. ..... 137/119.06
5,409,032 * 4/1995 Berfield ..... 137/115.03
5,427,151 * 6/1995 Pauley ..... 137/895
5,694,966 * 12/1997 Holder ..... 137/115.11

* cited by examiner

*Primary Examiner*—Kevin Shaver
*Assistant Examiner*—John Bastianelei
(74) *Attorney, Agent, or Firm*—Ladas and Parry

(57) ABSTRACT

A pressure washing machine has a valve assembly with an inlet opening and an outlet opening for a pressurized fluid, and a fluid interception element which is movable under the thrust of the fluid itself between a first operating position in which the fluid moves towards the outlet opening, and a second operating position in which the movement of the fluid is substantially inhibited; the valve assembly also has a by-pass valve, a shutter element of which is interposed between an inlet passage and an outlet passage of the valve itself and is controlled by a control element operated directly by the interception element to move the shutter element between a position in which the inlet and discharge passages are isolated from each other when the interception element is in its first operating position, and a position in which the passages are in communication with each other when the interception element is in its second operating position, irrespective of the pressure of the fluid in the outlet opening.

12 Claims, 3 Drawing Sheets

VALVE ASSEMBLY IN PARTICULAR FOR A PRESSURE WASHER

BACKGROUND OF THE INVENTION

The present invention concerns a valve assembly, in particular for a pressure washer.

In order to remove dirt and/or sediment from bodies or machinery in general, it is known to use high pressure washers comprising a delivery gun that can be provided with various accessories, and a volumetric pump connected to an electric motor and which sends a flow of water at a predetermined operating pressure to the gun. Generally, between the pump and the delivery gun are interposed a thermal installation provided with a heater in order to increase, where necessary, the temperature of the water delivered by the pump to a desired level, a safety valve for releasing any pressure surges that may occur within the tubing, and a by-pass valve.

In known pressure washing machines, the by-pass valve usually performs the dual function of discharging water delivered by the pump when the delivery of water from the gun ceases, that is, when the trigger of the gun is released, and of controlling the deactivation of the electric motor and heater when it is switched to a by-pass condition.

The by-pass valves usually used comprise an inlet opening connected to the pump, a delivery mouth opening connected to the gun via a unidirectional valve, a discharge opening, and a shutter element interposed between the inlet and discharge openings. The shutter element is held in a closed position by the discharge opening during the delivery of water through the gun, and is moved to an open or by-pass position, in which the inlet and discharge openings are in communication with each other, by a hydraulic command when the water pressure in the delivery opening reaches a predetermined threshold value on releasing the trigger of the gun. When in its open position, the shutter element stops the motor and any possible heating, thereby inhibiting the delivery of water by the pump.

The use of by-pass valves of the type described above, and the manner of control thereof means that the known pressure washers are unsatisfactory, both from a functional point of view, and as regards their service life.

This is essentially due to the fact that maintaining the by-pass valve in its by-pass condition is dependent on the pressure in the delivery opening remaining strictly constant. However, such a condition does not occur in reality, as the pressure in the delivery opening is never constant but varies continuously since small losses of fluid occur in all known pressure washers, and there is always some fluid leakage through the gun when the trigger thereof is released. In some cases, this leakage is inevitable, especially after a relatively long period of use of the gun while, in other cases, they must necessarily be provided for, for example, in order to avoid the fluid present in the circuit freezing when the machine operates at low temperatures. This therefore means that even when the trigger is released, the shutter element returns automatically to the closed condition when there is no pressure control as described above, with the consequent reactivation of the motor and the heater for a relatively short time which, in any case, is sufficient to raise the pressure in the delivery opening to the threshold value and return the shutter element to its open position. It is, therefore, clear that when the trigger is released, the machine operates in an unstable regime which is detrimental both for the pump and the heater, but especially for the motor which not only is forced to operate in a stop-go manner, but starting the motor is also associated with extremely high loads due to the presence of fluid at high pressure in the delivery opening, and this significantly reduces its expected service life.

SUMMARY OF THE INVENTION

The object of the present invention is to provide a valve assembly which enables the problems described above to be resolved in simple and economic manner.

According to the present invention there is provided a valve assembly, in particular for a pressure washer, including an inlet opening for a pressurized fluid; an outlet opening for the pressurized fluid; a fluid interception element interposed between the said inlet and outlet openings, and movable by the thrust of the said pressurized fluid between a first operating position in which the said pressurized fluid moves towards the said outlet opening, and a second operating position in which the movement of the said fluid is substantially prevented; and by-pass valve means having an inlet passage connected to the said input opening, a fluid discharge passage, closure means interposed between the said inlet and discharge passages, and means for moving the said closure means; characterised in that the said movement means include control means operated by the said interception element to move the said closure means between a position in which the said inlet and outlet passages are isolated from each other when the interception element is in its first operating position, and a position in which the passages are in communication with each other when the interception element is in its second operating position, irrespective of the pressure of the fluid in the said outlet opening.

BRIEF DESCRIPTION OF THE DRAWINGS

The invention will now be described with reference to the accompanying drawings, which illustrate a non-limitative embodiment, in which.

DETAILED DESCRIPTION OF THE INVENTION

Figure 1:
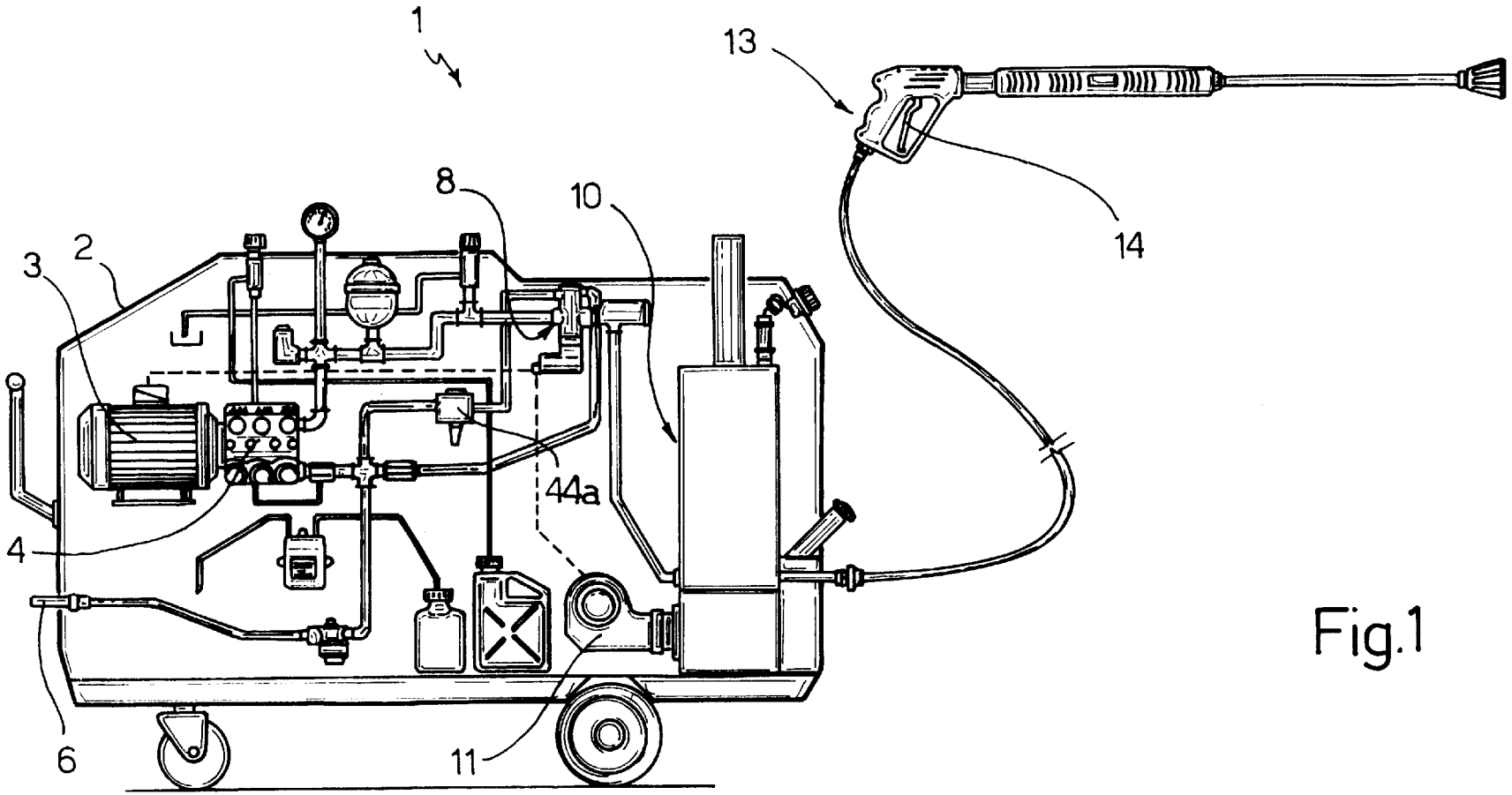
FIG. 1 shows, schematically and with parts removed for clarity, a high-pressure washer provided with a valve assembly formed according to the present invention.

In FIG. 1, the reference numeral 1 generally indicates a high pressure washer. The washer 1 includes an outer housing 2 accommodating an electric motor 3 for operating a pump 4 having an inlet opening in communication with a water supply pipe 6. The pump 4 also has a delivery duct connected in known way to an inlet opening 7 of a valve assembly 8, an outlet opening 9 of which is connected to an inlet of a water heating installation 10 including a known heater 11. The outlet from the installation 10 is connected, preferably by means of a flexible tube, to a delivery gun 13, known and not described in detail, having a trigger 14.

Figure 2:
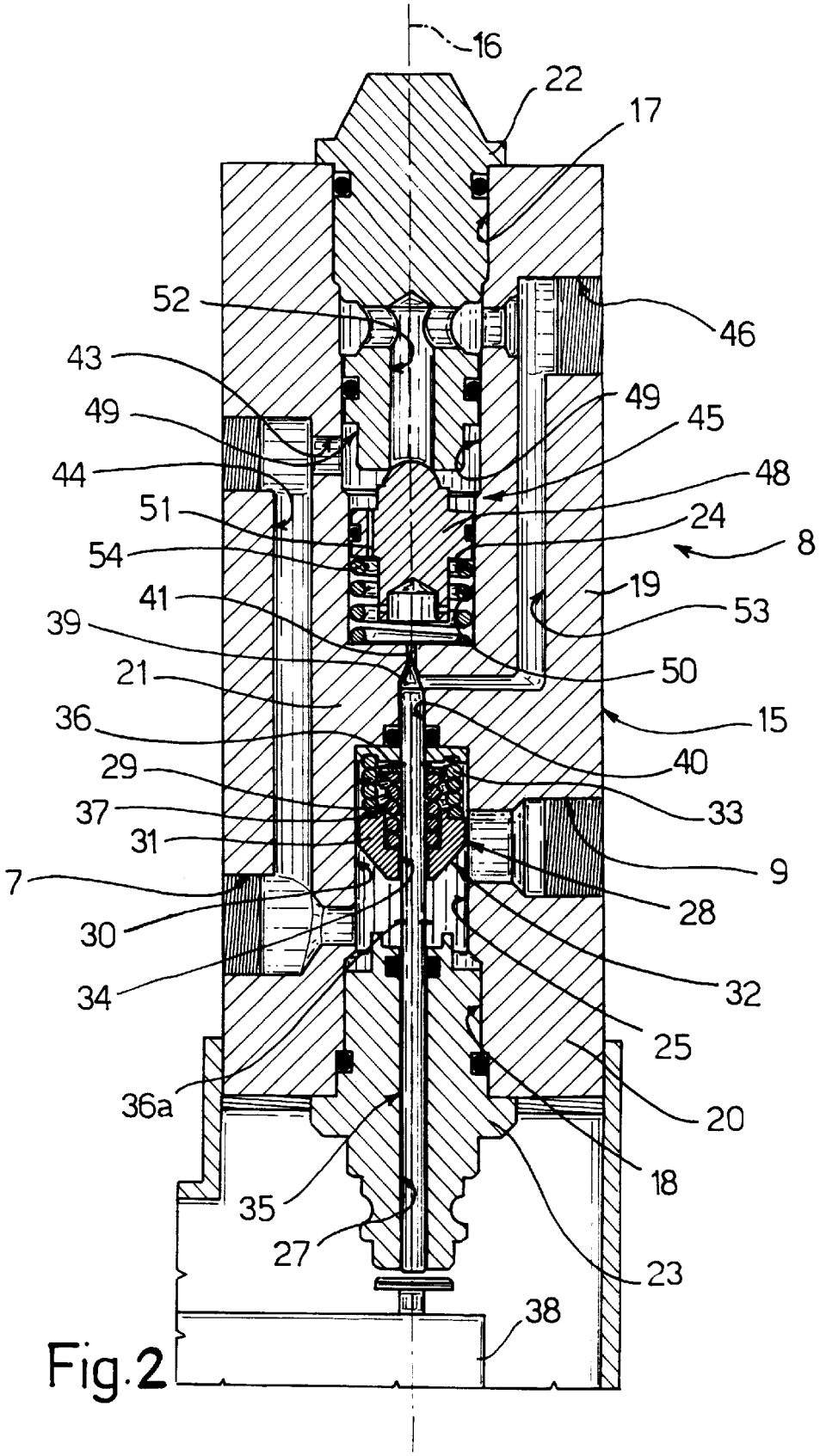
FIG. 2 shows, in section and on an enlarged scale, the valve assembly of FIG. 1.
Figure 3:
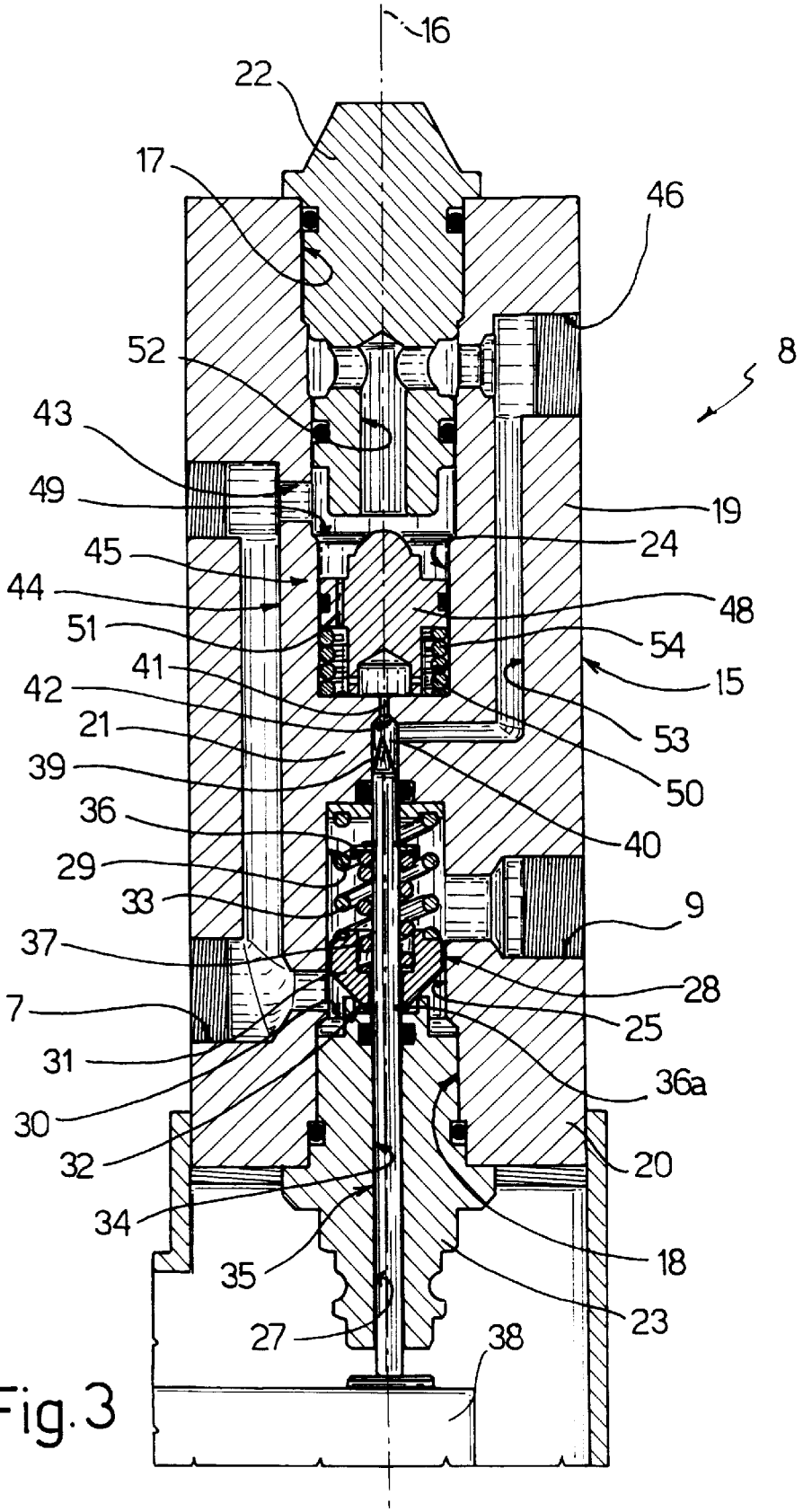
FIG. 3 is similar to FIG. 2 and shows the valve assembly of FIG. 2 in a different functional condition.

Still with reference to FIG. 1 and, in particular, with reference to FIGS. 2 and 3, the valve assembly 8 comprises a body 15, formed in one piece, having an axis 16 which defines two counterposed cavities extending along the axis 16, and indicated at 17 and 18. In particular, the cavities 17 and 18 are delimited by respective tubular portions 19 and 20 of the body 15, and a common base wall 21 extending orthogonal to the axis 16, and are closed by perspective closure bodies indicated at 22 and 23, each of which is coupled to an associated portion 19, 20 with a fluid-tight seal and defines, together with the portions 19, 20 and the base wall 21, associated cylindrical chambers 24 and 25.

The chamber 25 communicates with the inlet opening 7 and the outlet opening 9 through associated ducts formed in the portion 20 orthogonal to the axis 16 and in axially off-set positions, and communicates with the outside via a hole 27 formed in the closure body 23 coaxial with the axis 16. The chamber 25 accommodates an interception body 28 which extends coaxial with the axis 16, is supplied by an inner surface of the portion 20 in axially slidable manner, and subdivides the chamber 18 into two further variable volume chambers, indicated at 29 and 30. In use, the body 28 intercepts the flow of pressurized water leaving the inlet opening 7 and, for this purpose, includes a cylindrical portion 31, the outer diameter of which preferably approximates the inner diameter of the chamber 25 and is delimited, at the part facing the closure body 23, by a conical surface 32 tapered towards the body 23 itself.

The body 28 is axially movable by the thrust of the fluid between a closed position, illustrated in FIG. 3, and an open position, illustrated in FIG. 2. When the body 28 is in the closed position, it substantially inhibits the flow of water towards the outlet opening 9, the chambers 30 and 29 communicate with the inlet opening 7 and the outlet opening 9, respectively, and the body 28 is pushed towards the closure body 23 by the pressurized water in the chamber 29 and by a compression spring 33 housed in the chamber 29 itself On the other hand, when it is in the open position, to which it is moved and held by the action of the pressurized water leaving the inlet opening 7, the body 28 allows the water to move towards the outlet opening 9 and, consequently, to be delivered through the gun 13, and extends to such a position in which the chambers 29 and 30 are in communication with each other and both of the openings 7 and 9.

Still with reference to FIGS. 2 and 3, the body 28 has a through-hole 34 coaxial with the axis 16 and slidingly engaged with play by a cylindrical rod 35 which extends through the chambers 29 and 30 and the hole 27, and has fixedly attached thereto an axial abutment plate 36 located in the chamber 29, and an annular projection 36*a* located in the chamber 30. The plate 36 constitutes an axial abutment for the end of a compression spring 37, this also being housed in the chamber 29 with its opposite end located in abutment against the interception body 28, while the annular projection 36*a* forms an axial shoulder for the body 28 itself.

The rod 35 has an end portion projecting out of the body 23 through the hole 27, and acts on a known monostable switch 38 to deactivate the motor 3 and the heater 11 when the interception body 28 is in its closed position, and to operate the motor 3 and the heater 11 when the body 28 is in its open position. The rod 35 also has a tapered opposite end portion 39 which slidingly engages in fluid-tight manner a first portion 40 of a through-hole extending coaxial with the axis 16 through the wall 21, and having a second portion 41 with a smaller diameter than the first portion 40 and which opens out into the chamber 24. The portions 40 and 41 are connected to each other by a tapered conical portion 42 (FIG. 3) which defines, together with the end portion 39 and the portion 40, a known needle valve controlled by the interception body 28 and engaged by the end portion 39 with a fluid-tight seal when the body 28 is in the open position, and released from the portion 39 itself when the body 28 is in its closed position.

Still with reference to FIGS. 2 and 3, the chamber 24 has an inlet passage 43 which communicates with the inlet opening 7 via an axial duct 44, and with the pipe 6 via a pressure limiting valve 44*a* (FIG. 1). The chamber 24 forms part of a by-pass valve 45 which directs water delivered by the pump 4 into the pipe 6 on releasing the trigger 14 of the gun 13, and has a discharge passage 46 connected to the pipe 6 itself.

The chamber 24 houses a shutter element 48 which sub-divides the chamber 24 into two further variable volume chambers, indicated at 49 and 50, which communicate with each other via an axial through-hole 51 formed in the element 48 with a diameter comparable with that of the portion 41 and, preferably which varies between 0.5 and 2 mm. The chamber 49 also communicates with the inlet passage 43 and the discharge passage 46 via a duct 52 formed through the body 22, while the chamber 50 communicates with the discharge passage 46 via the hole portion 41 and a duct 53 formed in the portion 19 and the wall 21, which duct opens out into the hole portion 40, and houses a compression spring 54. The shutter element 48 is coupled to the inner surface of the portion 19 with a fluid-tight seal, and in slidable manner along the axis 16 between an extended position, illustrated in FIG. 2, in which the duct 52 is closed and the passages 43 and 46 are isolated from each other, and a retracted position (FIG. 3) in which the passages 43 and 46 are in communication with each other. In particular, when the element 48 is in its extended position, the chamber 49 communicates with the inlet opening 7, while the chamber 50 is hydraulically isolated from the discharge passage 46 by the aforesaid needle valve and communicates solely with the chamber 49 via the hole 51. On the other hand, when the shutter element 48 is in its retracted position, the chamber 49 communicates with both the passages 43 and 46, while the chamber 50 communicates with the discharge passage 46 via the duct 53 and the hole portion 41, so that the conical portion 42 is disengaged from the end portion 39 of the rod 35.

The operation of the machine 1 will now be described starting from a washing condition in which the motor 3 and the heater 11 are active, the pump 4 supplies a volume of washing water which is delivered via the gun 13 by squeezing the trigger 14, and the valve assembly 8 is in the condition illustrated in FIG. 2, in which the interception body 28 is held in its open position by the flow of water moving towards the gun 13 transversely of the axis 16, the needle valve isolates the chamber 50 from the discharge passage 46, and the shutter element 48 is held in its raised isolation position.

Starting from this condition, as soon as the trigger 14 is released, the flow of water through the duct 13 and the opening 9 stops, and the spring 33 moves the interception body 28 to its closure position. Following this movement, the portion 39 of the rod 35 disengages from the conical portion 42 and puts the chamber 50 in communication with the discharge passage 46, causing the sudden depressurization of the chamber 50, the immediate movement of the shutter element 48 to its retracted position and the consequent discharge of the water delivered by the pump 4 through the duct 44, the chamber 49 and the duct 52. Following the movement of the interception body 28, the rod 35 leaving the body 23 deactivates the motor 3 and the heater 11 so that the volume of water and the pressure in the duct 44 and the chamber 49 fall progressively until they reach a residual or threshold value, below which the action of the spring 54 prevails and returns the shutter element 48 to its extended isolation position.

At this point, the machine 1 remains in a stand-by condition until the trigger 14 is operated again, which causes a sudden pressure drop in the chamber 29 and the interception body 28, due to the thrust of the fluid in the chamber 30, moves progressively towards its open position, pulling with it the rod 35 which operates the motor 3 and the heater 11, and isolates the chamber 50 from the outlet passage 46, thereby re-establishing the original starting conditions.

From the above, it is clear that the particular characteristics of the valve assembly 8, with respect to the known arrangements, enable the machine, that is, the motor 3 and the heater 11, to be maintained constantly in a stand-by condition even if there are variations in pressure downstream of the outlet opening 9 caused by fluid leaking from the gun 13 and/or small losses of fluid from the ducts downstream of the opening 9.

This derives essentially from the fact that the interception body 28 is held in its closed position by the combined action of the pressurized fluid in the chamber 29 and the spring 33, the rigidity of which is chosen so that the interception body 28 is only able to move towards its open position when the trigger 14 of the gun 13 is squeezed, that is, only when the outlet opening 9 is connected to the discharge and the pressure in the chamber 29 is lower than that of the fluid in the opening 7.

Not only this, but when it is in its closed position, the interception body 28 does not form a water-tight seal between the openings 7 and 9 due to the play between the body 28 and the inner surface of the chamber 25, and between the body 28 and the rod 35, so that when the trigger 14 is released, the leakage of a minimal quantity of fluid due to the play is allowed. Therefore, it is clear that in the washer 1 described, the activation and deactivation of the motor 3 and the heater 11 is entirely under the direct control of the user squeezing and releasing the trigger 14 of the gun 13; not only this, but at the moment of each activation, the motor 3 experiences a relatively low load on starting, which means that the service life of the motor 3 is significantly increased with respect to the known arrangements in which the motor, even when the trigger is released and therefore the machine is theoretically in a stand-by condition, was subjected to frequent and uncontrollable starting and stopping under load.

Furthermore, the presence of the spring 37 limits the force applied by the portion 39 of the rod 35 against the portion 42, and therefore enables the needle valve to operate independently of the supply pressure of the water in the opening 7.

Finally, it is clear from the above that modifications and variations can be introduced to the machine 1 described without departing from the ambit of protection of the present invention. In particular, the water heating installation 10 can be absent from the machine 1, and the valve assembly 8 can include an interception body 28 and/or a by-pass valve 45 which are constructionally different from those described by way of example but which are, in any case, able to activate the motor 3 and possible heater 11 independently of the pressure of the fluid in the outlet opening 9, and only following the express request of the user by means of the operation of the trigger 14 of the gun 13.

What is claimed is:

1. A valve assembly (8), for a pressure washer (1) comprising a pump to pressurize a fluid and a gun for delivering the pressurized fluid, the valve assembly having an inlet opening (7) for pressurized fluid from the pump, an outlet opening (9) for supply of the pressurized fluid to said gun; a fluid interception element (28) interposed between the said inlet and outlet openings (7) (9) and movable by thrust of said pressurized fluid between a first operating position in which the said pressurized fluid flows towards the said outlet opening (9), and a second operating position in which the flow of the said fluid is substantially inhibited; and by-pass valve means (45) having an inlet passage (43) connected to the said inlet opening (7), a fluid discharge passage (46), closure means (48) interposed between the said inlet and discharge passages (43) (46), and movement means (54, 39, 41, 42) for moving the said closure means (48); said movement means (54, 39, 41, 42) including control means (39) operated by the said interception element (28) to move the said closure means (48) between a first position in which the said inlet and outlet passages (43) (46) are isolated from each other when the interception element (28) is in its first operating position, and a second position in which the passages (43) (46) are in communication with each other when the interception element (28) is in its second operating position, said inlet and outlet passages remaining in communication with each other when said interception element is in said second position irrespective of the pressure of the fluid in the said outlet opening (9).

2. An assembly according to claim 1, further comprising elastic means (33, 37) which urge the said interception element (28) towards the said second operating position.

3. An assembly according to claim 1, wherein the said interception element (28) is movable between the said operating positions in a direction (16) transverse to a direction of flow of said pressurized fluid from said inlet opening to said outlet opening.

4. An assembly according to claim 1, wherein the said by-pass valve means (45) including a chamber (24) housing the said closure means (48) and sub-divided by the closure means (48) itself into first (49) and second (50) variable volume chambers that communicate with each other; the first variable volume chamber (49) communicating with the said inlet opening (7) and the said outlet opening (9) when the said closure means (48) is in its communication position, and the said second variable volume chamber (50) communicating with the said discharge passage (46); the said control means include a closure element (39) which isolates the said second variable volume chamber (50) from the said discharge passage (46) when the said interception element is in the said first operating position, and which connects the said second chamber (50) and the discharge passage (46) when the interception element (28) is in the said second operating position.

5. An assembly according to claim 4, wherein the by-pass valve means (45) further include elastic means (54) housed in the said second chamber (50) to urge the said closure means (48) towards its isolation position.

6. An assembly according to claim 4, wherein the said closure element (39) is mechanically coupled to the said interception element (28) in order to move with respect to the interception element (28) itself between two end positions; elastic compression means (37) being interposed between the said interception element (28) and the said closure element (39) to urge the interception element (28) towards one of the end stroke positions.

7. An assembly according to claim 6, wherein the said interception element (28) has a through-hole (34) and the said closure element (39) has a guide portion (35) engaging the said hole (34) with play.

8. An assembly according to claim 7, further including a one-piece body (15) housing the said interception element (28), the said by-pass valve means (49) and the said movement means (54, 39, 41, 42); the guide portion (35) of the said closure element (39) projecting from the said body (15), and operating a switch means (38) which controls operation of said pump.

9. An assembly according to claim 8, wherein the said by-pass valve means (45), the said interception element (28) and the said closure element (39) are aligned along a common axis (16).

10. An assembly according to claim 1, which further comprises second control means (38) operated by the said interception element (28) for controlling the said pump (4).

11. An assembly according to claim 1, wherein said interception element is movable in a longitudinal direction between said first and second operating positions respectively to open and close flow of fluid from the inlet to the outlet openings, said closure means being movable in said longitudinal direction by said control means between said first and second position, said closure means being in communication with said inlet opening in both said positions thereof, said control means being movable in said longitudinal direction.

12. An assembly according to claim 11, wherein said pump is connected to an inlet pipe which supplies said fluid, said fluid discharge passage of said by-pass valve means being connected to said inlet pipe.

* * * * *

UNITED STATES PATENT AND TRADEMARK OFFICE

CERTIFICATE OF CORRECTION

PATENT NO. : 6,176,251 B1

DATED : January 23, 2001

INVENTOR(S) : Angelo Borgogno

It is certified that error appears in the above-identified patent and that said Letters Patent is hereby corrected as shown below:

On title page, item 73, "MIM" should read - - MTM - - .

Signed and Sealed this

Fifteenth Day of May, 2001

*Attest:*

Nicholas P. Godici

NICHOLAS P. GODICI

*Attesting Officer*

*Acting Director of the United States Patent and Trademark Office*